US011352734B2

(12) United States Patent
Zhao et al.

(10) Patent No.: US 11,352,734 B2
(45) Date of Patent: Jun. 7, 2022

(54) CIRCULATING AND FILTERING DEVICE OF WASHING MACHINE AND WASHING MACHINE

(71) Applicants: QINGDAO JIAONAN HAIER WASHING MACHINE CO., LTD., Shandong (CN); HAIER SMART HOME CO., LTD., Shandong (CN)

(72) Inventors: Zhiqiang Zhao, Shandong (CN); Sheng Xu, Shandong (CN); Peishi Lv, Shandong (CN)

(73) Assignees: QINGDAO JIAONAN HAIER WASHING MACHINE CO., LTD., Shandong (CN); HAIER SMART HOME CO., LTD., Shandong (CN)

( * ) Notice: Subject to any disclaimer, the term of this patent is extended or adjusted under 35 U.S.C. 154(b) by 0 days.

(21) Appl. No.: 16/956,835

(22) PCT Filed: Dec. 21, 2018

(86) PCT No.: PCT/CN2018/122653
§ 371 (c)(1),
(2) Date: Jun. 22, 2020

(87) PCT Pub. No.: WO2019/120284
PCT Pub. Date: Jun. 27, 2019

(65) Prior Publication Data

US 2020/0399816 A1 Dec. 24, 2020

(30) Foreign Application Priority Data

Dec. 22, 2017 (CN) ..... 201711401464.3

(51) Int. Cl.
*D06F 39/08* (2006.01)
*D06F 39/10* (2006.01)

(52) U.S. Cl.
CPC ..... *D06F 39/085* (2013.01); *D06F 39/10* (2013.01)

(58) Field of Classification Search
CPC ..... D06F 39/085; D06F 39/10; D06F 39/083; D06F 39/006
(Continued)

(56) References Cited

U.S. PATENT DOCUMENTS 7,073,520 B2 * 7/2006 Zanello ..... D06F 39/10 134/110
7,243,512 B2 * 7/2007 Kim ..... D06F 39/085 210/512.1
(Continued)

FOREIGN PATENT DOCUMENTS

CN 101324022 12/2008
CN 104514122 A 4/2015
(Continued)

OTHER PUBLICATIONS

International Search Report for PCT/CN2018/122653 dated Mar. 26, 2019 in English Translation.
(Continued)

*Primary Examiner* — Michael E Barr
*Assistant Examiner* — Thomas Bucci
(74) *Attorney, Agent, or Firm* — Arentfox Schiff LLP

(57) ABSTRACT

Provided is a circulating and filtering device of a washing machine, including a circulating pump assembly, where the circulating pump assembly includes an intake water cavity and a circulating water cavity that is in communication with the intake water cavity; and a filtering assembly disposed in the intake water cavity and rotatably connected to the circulating pump assembly, where the filtering assembly includes a blade and an inner cavity, where the inner cavity is in communication with the circulating water cavity, so that
(Continued)

water in the intake water cavity is filtered by the filtering assembly and enters the circulating water cavity.

14 Claims, 4 Drawing Sheets

(58) Field of Classification Search
USPC ..... 68/18 F
See application file for complete search history.

(56) References Cited

U.S. PATENT DOCUMENTS

| | | | | |
|---|---|---|---|---|
| 7,966,848 | B2 * | 6/2011 | Jang | D06F 39/083 68/18 F |
| 9,657,428 | B2 * | 5/2017 | Jeong | F04D 29/628 |
| 2004/0163427 | A1 * | 8/2004 | Oh | D06F 39/085 68/24 |
| 2005/0120758 | A1 * | 6/2005 | Thies | D06F 39/10 68/18 R |
| 2006/0000240 | A1 * | 1/2006 | Song | D06F 39/085 68/3 R |
| 2007/0240457 | A1 * | 10/2007 | Jang | D06F 39/083 68/18 F |
| 2008/0244836 | A1 * | 10/2008 | Kim | D06F 33/38 8/158 |
| 2008/0276657 | A1 * | 11/2008 | Kim | D06F 39/083 210/416.1 |
| 2010/0095713 | A1 * | 4/2010 | Yim | D06F 37/20 68/19 |
| 2011/0100071 | A1 * | 5/2011 | Mazzon | D06F 39/10 210/171 |
| 2013/0074554 | A1 * | 3/2013 | Chun | D06F 39/085 68/200 |
| 2013/0276484 | A1 * | 10/2013 | Mantle | D06F 39/10 68/18 F |
| 2017/0101734 | A1 * | 4/2017 | Jung | D06F 37/26 |

FOREIGN PATENT DOCUMENTS

| | | | | |
|---|---|---|---|---|
| CN | 104947374 | A | 9/2015 | |
| CN | 104947385 | A | 9/2015 | |
| EP | 2479336 | A1 | 7/2012 | |
| EP | 3124674 | A1 * | 2/2017 | B01D 37/03 |
| EP | 3124674 | A1 | 2/2017 | |
| JP | 2007222259 | A | 9/2007 | |
| KR | 19980018576 | U | 7/1998 | |

OTHER PUBLICATIONS

European Search Report for EP Patent Application No. 18890135.9, dated Jul. 2, 2021, 8 pages.

Office Action issued for corresponding CN Application No. 201711401464.3, dated Aug. 11, 2021, 4 pages.

* cited by examiner

CIRCULATING AND FILTERING DEVICE OF WASHING MACHINE AND WASHING MACHINE

This application is a U.S. National Stage Application, filed under 35 U.S.C. 371, of International Patent Application No. PCT/CN2018/122653, filed on Dec. 21, 2018, which claims priority to Chinese patent application No. 201711401464.3 filed on Dec. 22, 2017. The entire contents of all of which are incorporated herein by reference in their entireties.

The present application claims priority to Chinese patent application No. 201711401464.3 filed on Dec. 22, 2017, application of which is incorporated herein by reference in its entirety.

TECHNICAL FIELD

The present disclosure relates to the technical field of washing machines, for example, a circulating and filtering device of a washing machine and a washing machine.

BACKGROUND

In the related art, washing machines, such as a pulsator washing machine and a drum washing machine, all have a drainage function and an internal circulating function. The internal circulating function is mainly used to deliver washing water to a position (for example: a door window, a door seal, an inner drum, clothes, etc.) that needs to be washed in the washing machine by a circulating pump assembly through a circulating pipe, thereby realizing recycling utilization of the washing water, and then waste washing water is discharged from the washing machine by a drainage pump assembly.

In the related art, a filtering assembly is disposed in the circulating pump assembly of the washing machine, so that washing water for recycling utilization is filtered to prevent impurities such as threads and debris from entering the circulating pump assembly and causing failure of the circulating pump assembly, thereby avoiding affecting performance of the circulating pump and avoiding circulating water from entering the washing machine to cause secondary pollution to the washing machine or clothes. Generally, a filtering cavity is disposed in the filtering assembly, and a water inlet, a water outlet and a drainage port that are in communication with the filtering cavity are disposed on the filtering assembly. A detachable filtering member is disposed in the filtering cavity, and located between the water inlet and the water outlet along a water flowing direction. The washing water enters the filtering cavity and is filtered by the filtering member, and then the impurities such as the threads and debris are accumulated in the filtering cavity. Although the drainage pump assembly is connected to the filtering assembly and is in communication with the drainage port, the waste washing water can rinse a washing cavity. But due to accumulation of the impurities such as the threads and debris in the filtering cavity during filtration, and the filtering assembly is fixedly disposed, when the filtering assembly is filtered for a long time, the impurities such as the threads and debris accumulated in the filtering cavity is easy to block the filtering assembly.

SUMMARY

The present disclosure provides a circulating and filtering device of a washing machine and a washing machine, which solve a problem that a filtering assembly accumulates threads and debris in a filtering cavity when filtering washing water, which easily causes the filtering assembly to block.

Provided is a circulating and filtering device of a washing machine, including a circulating pump assembly and a filtering assembly. The circulating pump assembly includes an intake water cavity and a circulating water cavity that is in communication with the intake water cavity. The filtering assembly is disposed in the intake water cavity and rotatably connected to the circulating pump assembly. The filtering assembly includes a blade and an inner cavity, where the inner cavity is in communication with the circulating water cavity, so that water in the intake water cavity is filtered by the filtering assembly and enters the circulating water cavity.

Further provided is a washing machine, including the above-mentioned circulating and filtering device of the washing machine.

100—washing machine; 10—outer drum; 20—circulating pipe; 1—circulating pump assembly;

11—circulating pump; 12—circulating motor;

111—pump body; 112—pump cover; 113—seal ring;

1111—intake water cavity; 1112—circulating water cavity; 1113—water inlet; 1114—water outlet; 1115—residue water port; 1116—rotating impeller;

2—filtering assembly; 21—filtering body; 22—blade; 23—skirt structure; 24—anti-fall protrusion; 211—filtering hole; 25—inner cavity;

3—drainage assembly; 31—drainage pump; 32—drainage motor;

312—inlet; 313—outlet; 314—isolating plate; 315—impeller; 316—permanent magnet; 317—ring-shaped seal ring.

DETAILED DESCRIPTION

Figure 1:
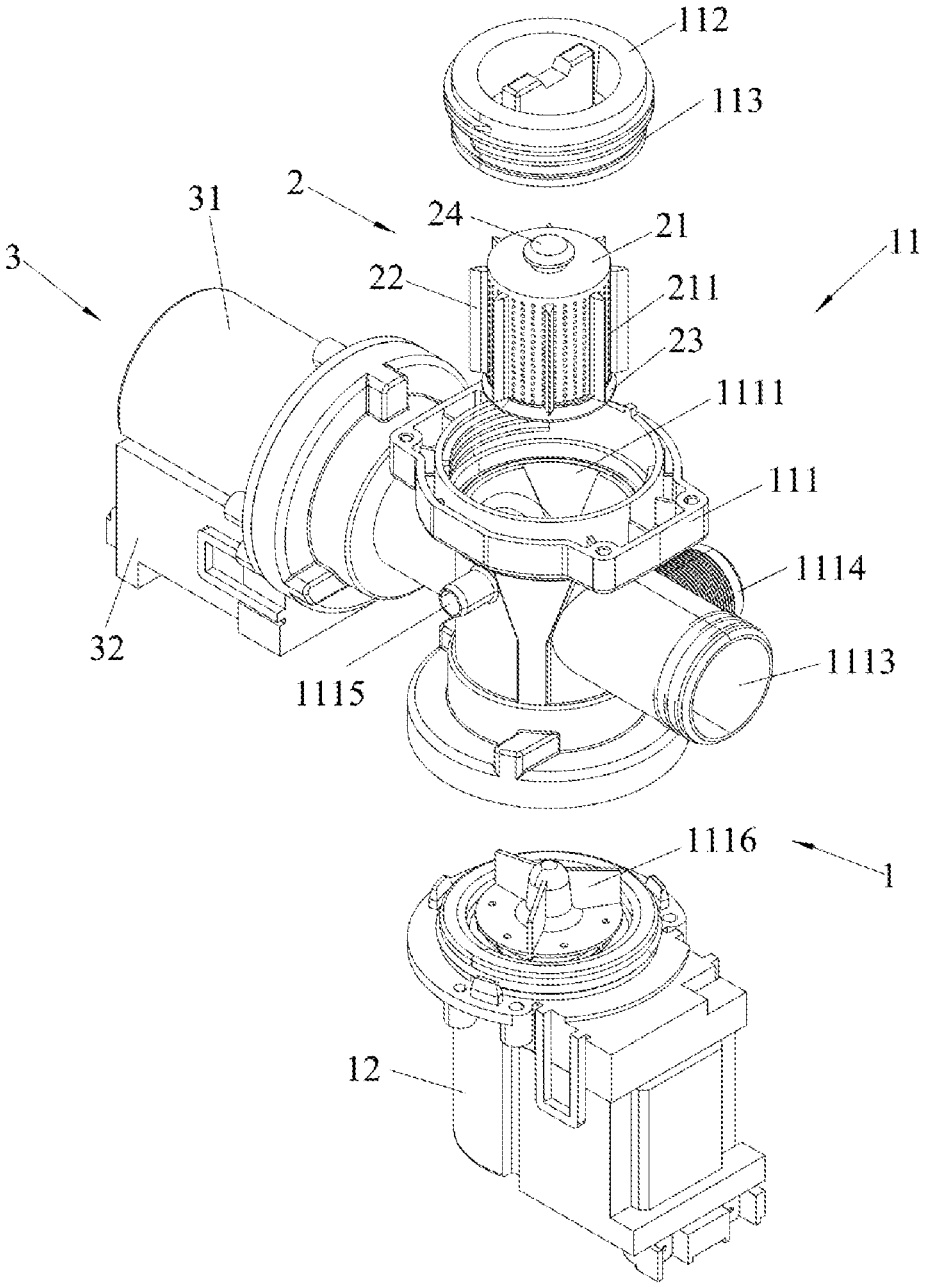
FIG. 1 is an exploded schematic view of a circulating and filtering device of a washing machine according to an embodiment of the present disclosure.
Figure 2:
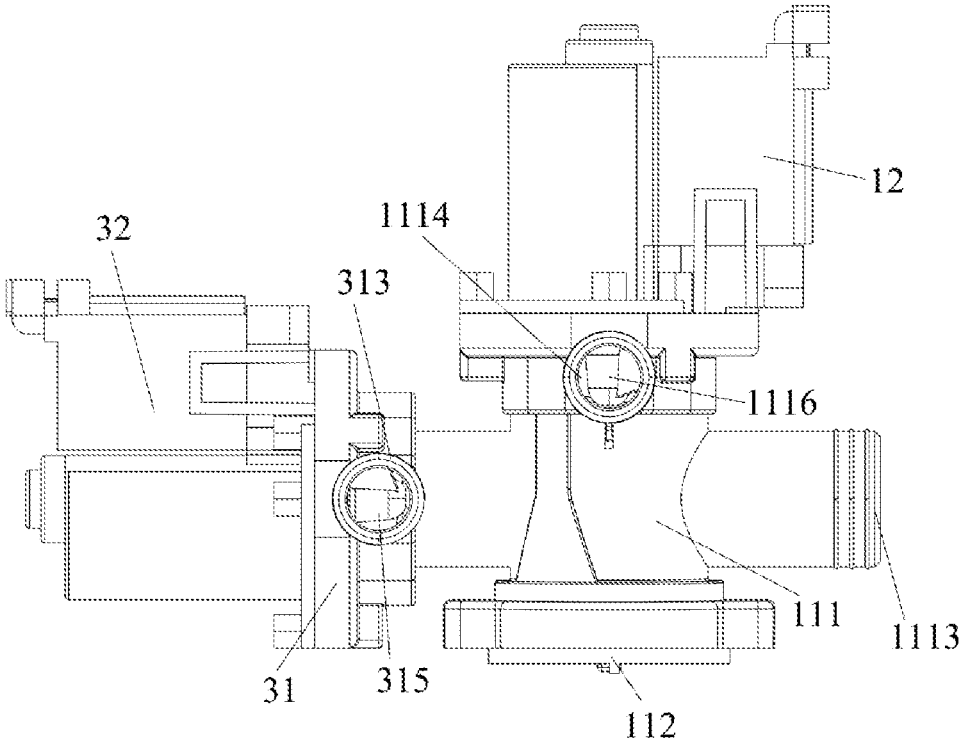
FIG. 2 is a front view of a circulating and filtering device of a washing machine according to an embodiment of the present disclosure.
Figure 6:
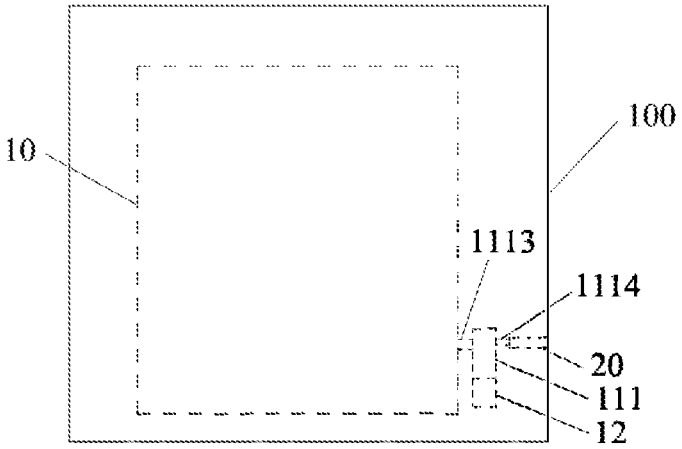
FIG. 6 is a schematic diagram of a washing machine according to an embodiment of the present disclosure.

The present embodiment provides a circulating and filtering device of a washing machine. As shown in FIGS. 1, 2 and 6, the circulating and filtering device of the washing machine includes a circulating pump assembly 1, a drainage assembly 3 and a filtering assembly 2, where the circulating pump assembly 1 is connected to the washing machine through a circulating pipe 20, so that recycling of washing water is realized. In an embodiment, the circulating pump assembly 1 includes a circulating pump 11 and a circulating motor 12, where the circulating pump 11 includes a pump body 111 and a pump cover 112, and a seal ring 113 is disposed between the pump body 111 and the pump cover 112. The seal ring 113 is configured to strengthen sealing between the pump body 111 and the pump cover 112. As shown in FIG. 1, the pump body 111 is provided with a water inlet 1113 and a water outlet 1114. An intake water cavity 1111 and a circulating water cavity 1112 that is in communication with the intake water cavity 1111 are disposed in the pump body 111. The intake water cavity 1111 is provided with an opening which is blocked by the pump cover 112. The intake water cavity 1111 is in communication with the water inlet 1113 and the water outlet 1114. The intake water cavity 1111 is in communication with an outer drum 10 of a washing machine 100 through the water inlet 1113. Water in the outer drum 10 flows into the intake water cavity 1111, and then flows into the washing machine 100 through the circulating pipe 20 connected to the water outlet 1114, so that water recycling is realized, and circulating water is able to spray a door window, a door seal, an inner drum (an inner cylinder), clothes, etc. The circulating motor 12 is connected to the circulating pump 11, and configured to drive the circulating pump 11 to deliver the circulating water into the washing machine 100.

Figure 3:
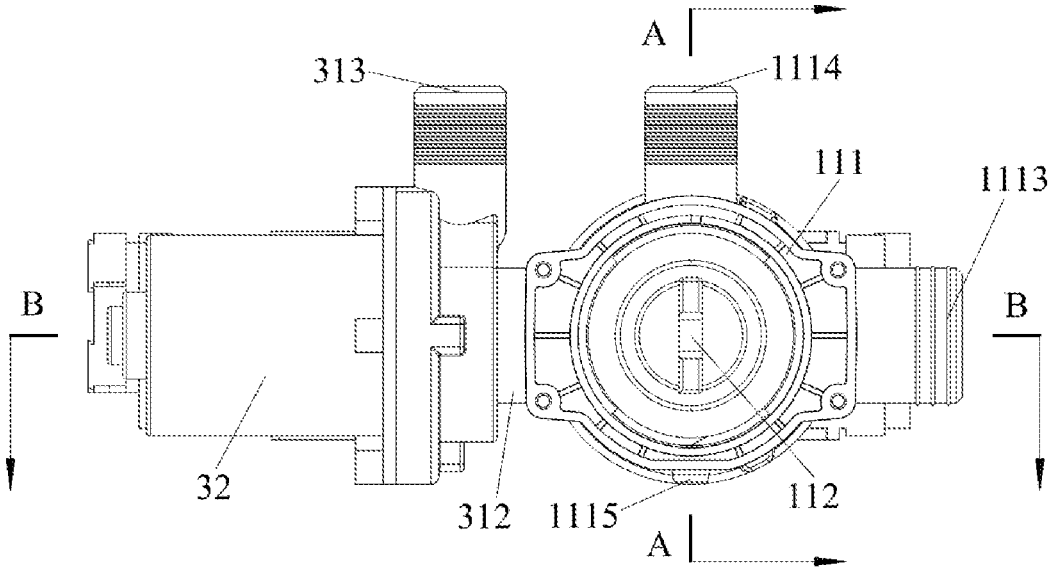
FIG. 3 is a front view of a circulating and filtering device of a washing machine according to an embodiment of the present disclosure.
Figure 4:
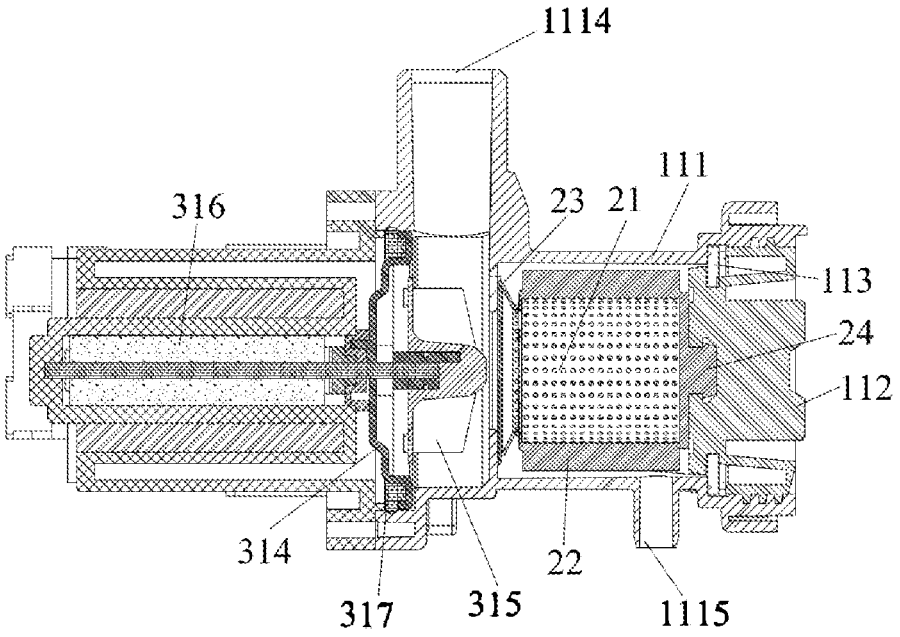
FIG. 4 is a cross-sectional view taken along a line A-A of FIG. 3.
Figure 5:
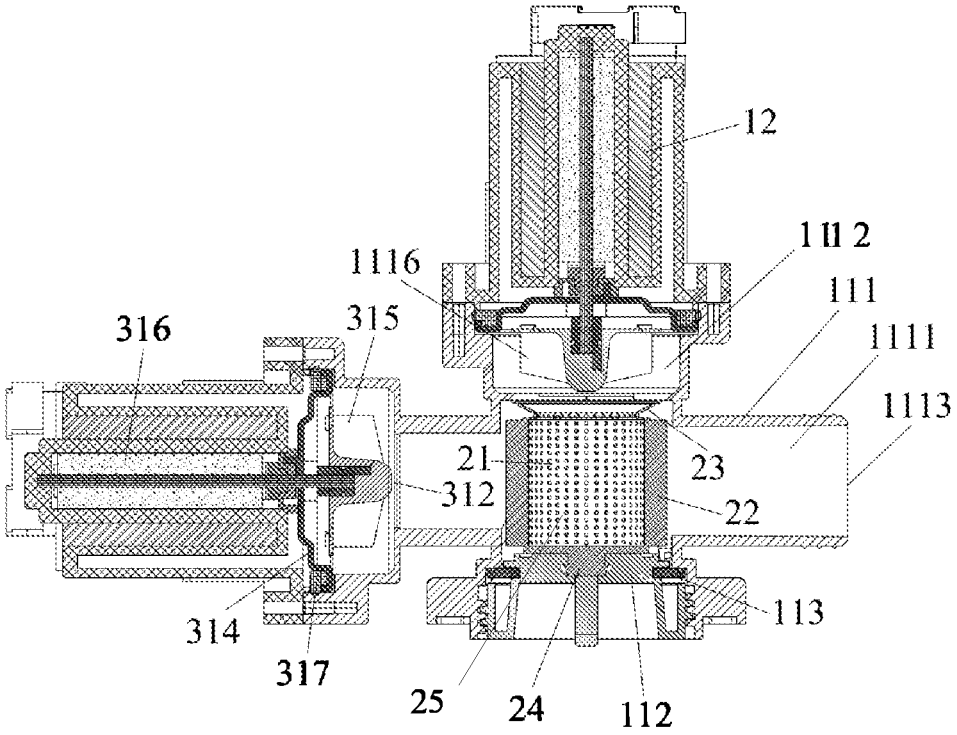
FIG. 5 is a cross-sectional view taken along a line B-B of FIG. 3.

As shown in FIGS. 3, 4 and 5, the filtering assembly 2 is disposed in the intake water cavity 1111 of the circulating pump assembly 1 and rotatably connected to the circulating pump assembly 1, and an inner cavity 25 of the filtering assembly 2 is in communication with the circulating water cavity 1112 of the circulating pump assembly 1. The water in the outer drum 10 of the washing machine 100 flows into the intake water cavity 1111 of the circulating pump assembly 1, and then enters the inner cavity 25 of the filtering assembly 2 from an outer wall of the filtering assembly 2, so that the water is filtered. Then the filtered water enters the circulating water cavity 1112 that is in communication with the inner cavity 25 of the filtering assembly 2, and the water is recycled via a rotating impeller 1116 in the circulating water cavity 1112. Impurities in the water are dammed by the filtering assembly 2 into a space between the intake water cavity 1111 and the filtering assembly 2 to realize filtration of impurities such as threads and debris, and the impurities such as the threads and debris are filtered and accumulated in the space between the filtering assembly 2 and the intake water cavity 1111 and drained by the drainage assembly 3. The filtering assembly 2 is disposed opposite to the pump cover 112, and the filtering assembly 2 may be cleaned by opening the pump cover 112.

In an embodiment, as shown in FIGS. 1 and 4, the filtering assembly 2 includes a filtering body 21 and a blade 22 disposed on an outer wall of the filtering body 21. The blade 22 may be strip-shaped, spiral-shaped, or the like. In the present embodiment, a plurality of strip-shaped blades 22 are disposed along an axial direction of the filtering assembly 2, and evenly distributed on the outer wall of the filtering assembly 2 in a circumferential direction of the filtering assembly 2. Such arrangement of the blades 22 enables the water entering the intake water cavity 1111 to drive the filtering assembly 2 to rotate at a high speed so as to prevent the filtering assembly 2 from being blocked. The filtering body 21 is provided with a filtering hole 211. Arrangement of the filtering hole 211 realizes the filtration of water, and prevents the threads and debris from entering the inner cavity 25 of the filtering assembly 2.

As shown in FIG. 1, a first end of the filtering body 21 is in communication with the circulating water cavity 1112, and a second end of the filtering body 21 is in non-communication with the circulating water cavity 1112. The second end of the filtering body 21 is provided with an anti-fall protrusion 24, the anti-fall protrusion 24 is clamped onto the pump cover 112 of the circulating pump assembly 1, and the filtering assembly 2 is rotatable relative to the pump cover 112. Such arrangement of the anti-fall protrusion 24 may prevent the filtering assembly 2 from being separated from the circulating pump assembly 1.

An end of the filtering body 21 adjacent to the circulating water cavity 1112 is provided with a skirt structure 23, where the skirt structure 23 is arranged to extend into the circulating water cavity 1112, and a diameter of the skirt structure 23 gradually increases in a direction from the filtering assembly 2 toward the circulating water cavity 1112. The arrangement of the skirt structure 23 may effectively reduce a gap between the filtering assembly 2 and the circulating water cavity 1112, and prevent unfiltered circulating water from entering the circulating water cavity 1112.

As shown in FIGS. 1 and 4, the pump body 111 is further provided with a residue water port 1115 that is in communication with the intake water cavity 1111. The residue water port 1115 is connected to a residue water pipe, and residual water in the intake water cavity 1111 is discharged from the washing machine 100 through the residual water pipe, so as to prevent the residual water from being stored in the intake water cavity 1111.

As shown in FIG. 5, the drainage assembly 3 is in communication with the intake water cavity 1111, and the filtered impurities in the space between the filtering assembly 2 and the intake water cavity 1111 are delivered into a housing of the drainage assembly 3 by water flow and discharged from the washing machine 100 by the drainage assembly 3. Therefore, the filtering assembly 2 is able to be self-cleaned without disassembling.

The drainage assembly 3 may be a drainage valve or a drainage pump assembly. The drainage valve is configured to control opening and closing of the intake water cavity 1111 to ensure that the impurities such as the threads and debris in the intake water cavity 1111 are discharged from the washing machine 100. As shown in FIG. 5, the drainage pump assembly is taken as an example in the present embodiment. As shown in FIGS. 1, 3, and 5, the drainage pump assembly includes a drainage pump 31 and a drainage motor 32. The drainage pump 31 is provided with an inlet 312 and an outlet 313, the inlet 312 is in communication with the intake water cavity 1111, and the outlet 313 is in communication with the drainage pipe. The drainage motor 32 is connected to the drainage pump 31, and configured to drive the drainage pump 31 to discharge the waste water out of the washing machine 100.

As shown in FIG. 5, an isolating plate 314 is disposed in a housing of the drainage pump 31, and disposed between an impeller 315 and a permanent magnet 316 of the drainage pump 31. The arrangement of the isolating plate 314 prevents water from entering and causing damage to the permanent magnet 316. A ring-shaped seal ring 317 is disposed between the isolating plate 314 and a housing of the drainage pump 31 to strengthen sealing of the isolating plate 314.

When the washing machine 100 starts water circulating spraying, the circulating motor 12 starts, the water flow in the outer drum 10 enters the intake water cavity 1111 of the circulating pump 11. The circulating water may only pass through the filtering hole 211 of the filtering assembly 2 into the filtering assembly 2 and then flow into the circulating water cavity 1112, while impurities in the circulating water are dammed by the filtering hole 211 in the space between the intake water cavity 1111 and the filtering assembly 2. Since the filtering assembly 2 is provided with the blade 22, the water flow flushes the blade 22 to drive the filtering assembly 2 to operate at a high speed, and the impurities such as the threads and debris are difficult to be accumulated at the filtering hole 211, therefore, the filtering assembly 2 will not be blocked.

When the washing machine 100 starts to drain, the drainage motor 32 starts, and the water flow in the outer drum 10 enters the intake water cavity 1111 of the circulating pump 11. Due to presence of the filtering assembly 2, the water flow flows through the space between the filtering assembly 2 and the pump body 111 to the drainage pump 31, and then is discharged through the drainage pipe. The filtered impurities in the space between the filtering assembly 2 and the pump body 111 are delivered by the water flow to the drainage pump 31, and discharged out of the washing machine 100.

The washing machine 100 provided in the present embodiment may filter the threads and debris, effectively avoid a problem of threads and debris attached on clothes, and realize cleaning of the filtering assembly 2 in the circulating pump 11 of the washing machine 100. The consumer does not need to open the pump cover 112 to clean the filtering assembly 2. The filtering assembly 2 is rotatably disposed in the intake water cavity 1111, effectively avoiding block of the filtering hole 211.

The present embodiment provides the washing machine 100 including the above-mentioned circulating and filtering device of the washing machine, the outer drum 10 and the circulating pipe 20, where the water inlet 1113 of the circulating pump 11 is in communication with the outer drum 10, and the above-mentioned circulating pipe 20 is disposed between the water outlet 1114 of the circulating pump 11 and the washing machine 100. The washing machine 100 may prevent the threads and debris from blocking the filtering assembly 2, and realize self-cleaning of the washing machine 100.

What is claimed is:

1. A circulating and filtering device of a washing machine, comprising:

a circulating pump assembly comprising a circulating pump, an intake water cavity and a circulating water cavity that is in communication with the intake water cavity;

a filtering assembly disposed in the intake water cavity and rotatably connected to the circulating pump assembly, wherein the filtering assembly comprises a filtering body rotatably connected to the circulating pump assembly, a blade and an inner cavity, wherein the inner cavity is in communication with the circulating water cavity, so that water in the intake water cavity is filtered by the filtering assembly and enters the circulating water cavity; the blade is disposed on an outer wall of the filtering body, and the inner cavity is disposed in the filtering body; and a skirt structure disposed on a first end of the filtering body adjacent to the circulating water cavity, wherein the skirt structure is arranged to extend into the circulating water cavity and in communication with the circulating water cavity, and a diameter of the skirt structure gradually increases in a direction from the filtering assembly toward the circulating water cavity.

2. The circulating and filtering device of the washing machine according to claim 1, wherein a filtering hole is disposed on the filtering body, and in communication with the inner cavity.

3. The circulating and filtering device of the washing machine according to claim 1, wherein a second end of the filtering body that is in non-communication with the circulating water cavity is provided with an anti-fall protrusion, and the anti-fall protrusion is clamped to a pump cover of the circulating pump assembly.

4. The circulating and filtering device of the washing machine according to claim 1, wherein the circulating pump comprises a water inlet and a water outlet; and the circulating pump assembly further comprises a circulating motor configured to drive the circulating pump to deliver circulating water into the washing machine.

5. The circulating and filtering device of the washing machine according to claim 4, wherein the circulating pump comprises a pump body and a pump cover, wherein the water inlet and the water outlet are disposed on the pump body, the water inlet is in communication with the intake water cavity, and the water outlet is in communication with the circulating water cavity.

6. The circulating and filtering device of the washing machine according to claim 1, further comprising a drainage assembly, wherein the drainage assembly is a drainage valve or a drainage pump assembly.

7. The circulating and filtering device of the washing machine according to claim 6, wherein the drainage assembly is the drainage pump assembly, and the drainage pump assembly comprises:

a drainage pump provided with an inlet and an outlet, wherein the inlet is in communication with the intake water cavity, and the outlet is configured to perform drainage; and a drainage motor configured to drive the drainage pump to drain waste water out of the washing machine.

8. A washing machine, comprising a circulating and filtering device,. wherein the circulating and filtering device comprises:

a circulating pump assembly comprising a circulating pump, an intake water cavity and a circulating water cavity that is in communication with the intake water cavity;

a filtering assembly disposed in the intake water cavity and rotatably connected to the circulating pump assembly, wherein the filtering assembly comprises a filtering body rotatably connected to the circulating pump assembly, a blade and an inner cavity, wherein the inner cavity is in communication with the circulating water cavity, so that water in the intake water cavity is filtered by the filtering assembly and enters the circulating water cavity; the blade is disposed on an outer wall of the filtering body, and the inner cavity is disposed in the filtering body; and a skirt structure disposed on a first end of the filtering body adjacent to the circulating water cavity, wherein the skirt structure is arranged to extend into the circulating water cavity and in communication with the circulating water cavity, and a diameter of the skirt structure gradually increases in a direction from the filtering assembly toward the circulating water cavity.

9. The washing machine according to claim 8, wherein a filtering hole is disposed on the filtering body, and in communication with the inner cavity.

10. The washing machine according to claim 8, wherein a second end of the filtering body that is in non-communication with the circulating water cavity is provided with an anti-fall protrusion, and the anti-fall protrusion is clamped to a pump cover of the circulating pump assembly.

11. The washing machine according to claim 8, wherein the circulating pump comprises a water inlet and a water outlet; and the circulating pump assembly further comprises a circulating motor configured to drive the circulating pump to deliver circulating water into the washing machine.

12. The washing machine according to claim 11, wherein the circulating pump comprises a pump body and a pump cover, wherein the water outlet are disposed on the pump body, the water inlet is in communication with the intake water cavity, and the water outlet is in communication with the circulating water cavity.

13. The washing machine according to claim 8, further comprising a drainage assembly, wherein the drainage assembly is a drainage valve or a drainage pump assembly.

14. The washing machine according to claim 13, wherein the drainage assembly is the drainage pump assembly, and the drainage pump assembly comprises:

a drainage pump provided with an inlet and an outlet, wherein the inlet is in communication with the intake water cavity, and the outlet is configured to perform drainage; and a drainage motor configured to drive the drainage pump to drain waste water out of the washing machine.

* * * * *